US007618216B1

(12) United States Patent
Tong et al.

(10) Patent No.: US 7,618,216 B1
(45) Date of Patent: Nov. 17, 2009

(54) FAULTLINE FEARLESS NANOTUBE HOMES

(76) Inventors: Lucas Tong, 1807 Limetree La., Mountain View, CA (US) 94040; Nimisha Pattada, 815 Pico La., Los Altos, CA (US) 94022

( * ) Notice: Subject to any disclaimer, the term of this patent is extended or adjusted under 35 U.S.C. 154(b) by 313 days.

(21) Appl. No.: 11/728,247

(22) Filed: Mar. 23, 2007

Related U.S. Application Data

(60) Provisional application No. 60/859,842, filed on Nov. 17, 2006.

(51) Int. Cl.
*E02D 31/02* (2006.01)

(52) U.S. Cl. ..... 405/229; 405/20; 405/302.4; 977/902

(58) Field of Classification Search ..... 405/229, 405/239, 251, 252; 977/902; 52/167.1, 294, 52/414

See application file for complete search history.

(56) References Cited

U.S. PATENT DOCUMENTS 2,454,292 A * 11/1948 Pickett ..... 405/20
2,971,295 A * 2/1961 Reynolds ..... 52/223.7
3,732,649 A * 5/1973 Mehran ..... 52/169.3
5,421,136 A * 6/1995 Van De Peer ..... 52/294
5,881,527 A * 3/1999 Haseotes ..... 52/705
6,062,770 A * 5/2000 Beck ..... 405/230

OTHER PUBLICATIONS

Makar, J.M.; Beaudoin, J.J.; Carbon Nanotubes and Their Applcation in the Construction Industry; Jun. 25, 2003; National Research Council of Canada.*

First Lego League/Missions, http://www.firstlegoleague.org/default.aspx?pid=23720, downloaded Jul. 15, 2007, 3 pages.

VanCleave, Janice, Earthquakes, Mind-boggling Experiments You Can Turn Into Science Fair Projects, John Wiley & Sons, Inc., 1993, 88 pages.

Nicholson, Cynthia Pratt, "Earthquake!", Kids Can Press Ltd., Tonawanda, NY, 2002, 32 pages.

* cited by examiner

*Primary Examiner*—David J Bagnell
*Assistant Examiner*—Nicholas A Wilbur

(57) ABSTRACT

A structure to strengthen a house against earth movement, such as earthquake. The house can be known as the central house. In one embodiment, there is a slab under the house. The central house has a number of neighboring houses around it. There is also a slab under each of the neighboring houses. The slab under the central house can be known as the central slab, and the slabs of the neighboring houses can be known as the neighboring slabs. At least one carbon nanotube wire is embedded in each slab. The at least one carbon nanotube wire in the central slab is connected to two of the carbon nanotube wires in neighboring slabs.

20 Claims, 7 Drawing Sheets

FAULTLINE FEARLESS NANOTUBE HOMES

CROSS REFERENCE TO RELATED APPLICATION

This application claims benefit of U.S. Provisional Patent Application No. 60/859,842, filed Nov. 17, 2006, and entitled "A WEB OF CARBON NANOTUBES TO STRENGTHEN HOUSES AND OTHER STRUCTURES AGAINST EARTHQUAKES," which is hereby incorporated herein by reference.

BACKGROUND OF THE INVENTION

1. Field of the Invention

The present invention relates generally to earthquake protection and more particularly to reducing damages in houses from earthquake.

2. Description of the Related Art

One of the most destructive forces in human civilization is earthquakes. Millions have been killed by them. Most of the deaths were due to indirect causes, typically the collapsing of houses and structures. Through many centuries, numerous techniques have been implemented to try to strengthen houses from earthquakes. However, none has been very successful and relatively easy to implement at the same time. Thus, it is desirable to find relatively easy to implement techniques to prevent and/or reduce damages to houses due to earthquakes.

SUMMARY OF THE INVENTION

In one embodiment, the present invention is related to using a web of carbon nanotube wires to tie the foundations of houses together. With the foundations of the houses linked together by carbon nanotube wires, the foundations support each other. This will reduce the chance of the houses from collapsing even in major earthquakes. In another embodiment, a web of carbon nanotube wires links the foundations of single-family homes together, which in turn reduces earthquake damages to the single-family homes.

Other aspects and advantages of the present invention will become apparent from the following detailed description, which, when taken in conjunction with the accompanying drawings, illustrates by way of example the principles of the invention.

Same numerals in FIGS. 1-7 are assigned to similar elements in all the figures. Embodiments of the invention are discussed below with reference to FIGS. 1-7. However, those skilled in the art will readily appreciate that the detailed description given herein with respect to these figures is for explanatory purposes as the invention extends beyond these limited embodiments.

DETAILED DESCRIPTION OF THE INVENTION

Carbon nanotubes are structurally very strong. For example, a carbon nanotube wire made of carbon nanotube having the thickness of a toothpick can have sufficient strength to pick up a car. They are also relatively light weight. For example, carbon nanotubes weigh about one-sixth as much as a steel cable of the same size.

Many houses use concrete slabs as their foundation. These slabs can be known as floating slabs. Typically such a slab is a flat concrete pad formed directly on the ground. These slab structures work particularly well on level sites in warm climates. Around the edge of a slab, the concrete can form a beam that can be 2 feet deep. The rest of the slab can be 4 to 6 inches thick, with a 4 to 6 inch layer of gravel beneath the slab. There can be a thin sheet of plastic between the concrete and the gravel to keep moisture out. Embedded in the concrete can be wire mesh and steel reinforcing bars. Typically sewer pipes and electrical conduit also can be embedded in the slab.

Figure 1:
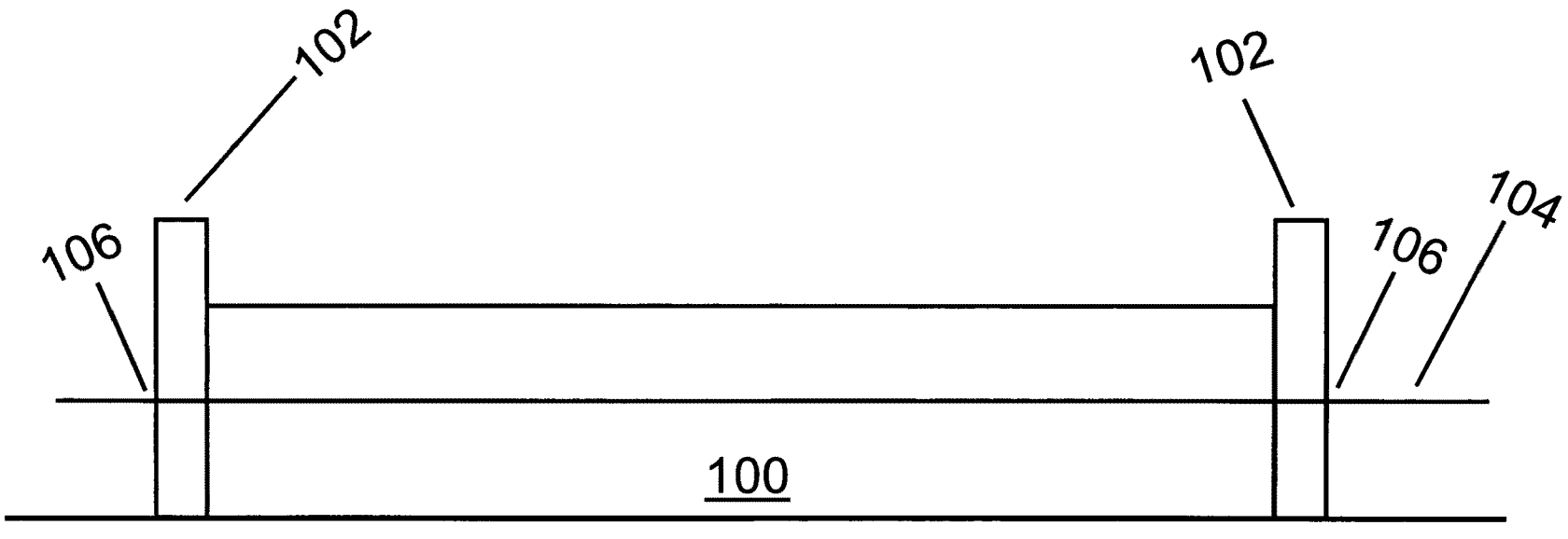
FIG. 1 shows a carbon nanotube wire embedded in a slab according to one embodiment of the invention.

FIG. 1 shows one embodiment of a carbon nanotube wire 104 embedded in a concrete slab 100. During formation, the slab can be bounded by panels, such as 102. These can be wood panels. There is a small hole 106 in each panel. Before the concrete is poured, the carbon nanotube wire 104 is threaded through the two holes 106. Then concrete is poured to form the slab 100. The carbon nanotube wire 104 can be stretched during the solidification period of the concrete. This can reduce slack in the carbon nanotube wire.

Figure 2:
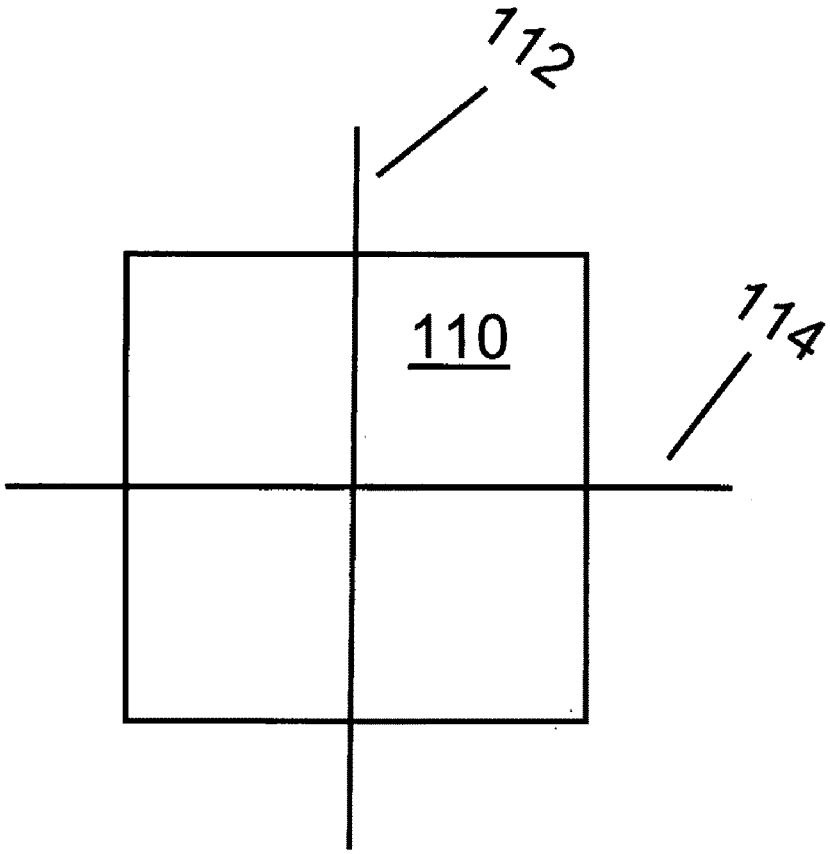
FIG. 2 shows the top view of a slab with two carbon nanotube wires embedded inside according to one embodiment of the invention.

FIG. 2 shows the top view of a slab 110 with two carbon nanotube wires, 112 and 114, embedded inside according to one embodiment. These carbon nanotube wires extend across the slab 110. In another embodiment, there can be more carbon nanotube wires extended across a slab.

Figure 3:
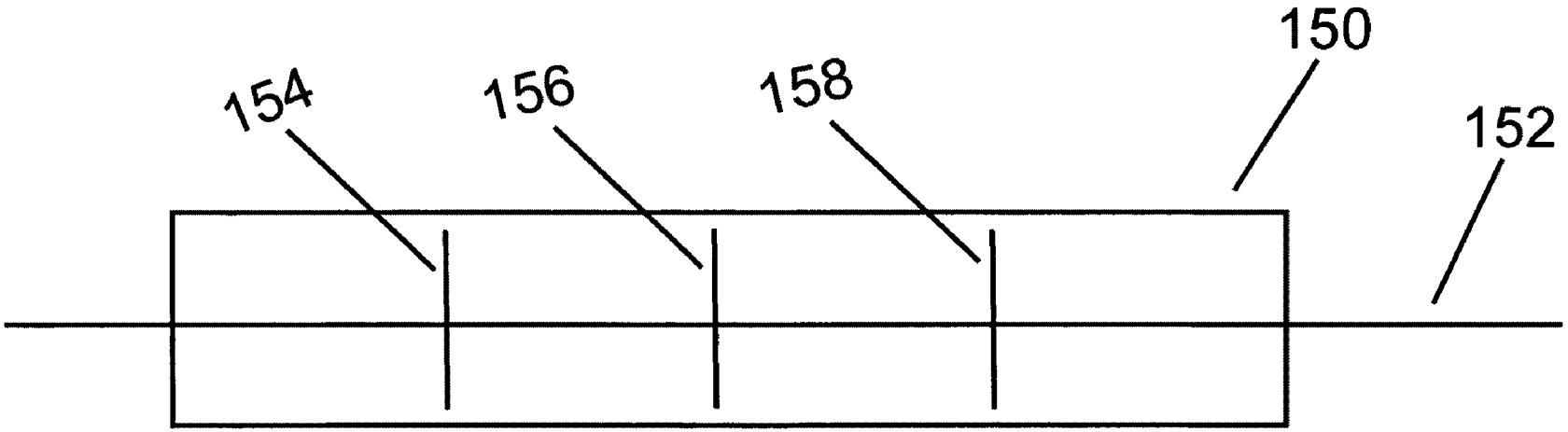
FIG. 3 shows the side view of a slab with a substantially horizontal carbon nanotube wire and a number of substantially vertical carbon nanotube wires according to one embodiment of the invention.

FIG. 3 shows the side view of a slab 150 with a substantially horizontal carbon nanotube wire and a number of substantially vertical carbon nanotube wires according to one embodiment. The substantially horizontal carbon nanotube wire 152 extends across the plane of the slab 150, and the substantially vertical carbon nanotube wires 154, 156 and 158, extend substantially perpendicular to the horizontal carbon nanotube wire 152. These additional vertical carbon nanotube wires can be tied to the horizontal carbon nanotube wire. In this example, three vertical carbon nanotube wires are shown. In other examples, there can be more or fewer vertical carbon nanotube wires. These vertical carbon nanotube wires provide additional structural strengths to the slab 150. One way to form the vertical carbon nanotube wires is to tie them to the horizontal carbon nanotube wire after the concrete is poured but before the concrete solidifies to form the slab. The structural strength of the liquid concrete can substantially maintain the orientation of the vertical carbon nanotube wires.

Figure 4:
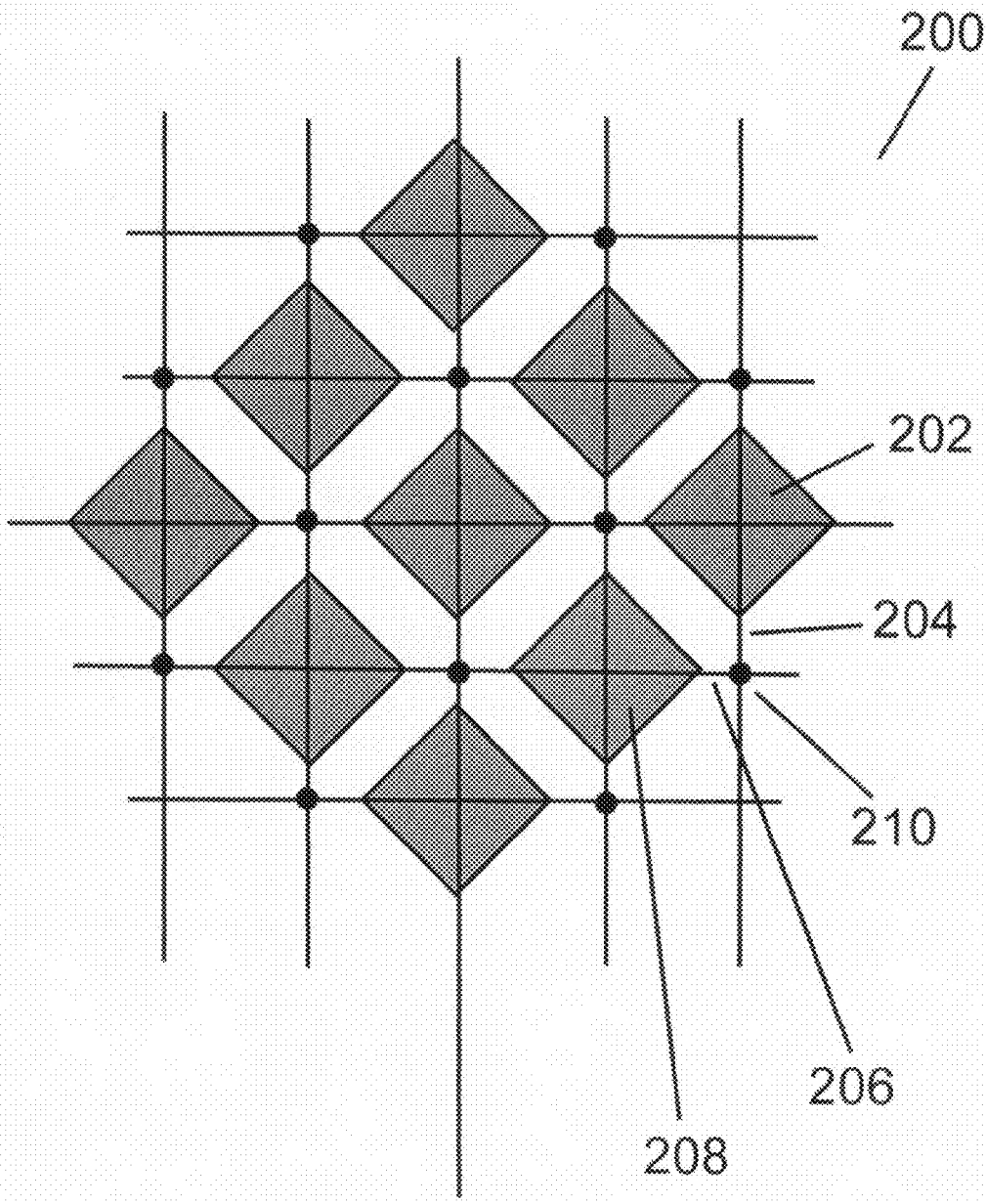
FIG. 4 shows one embodiment of the invention with nine slabs, connected together by carbon nanotube wires.
Figure 5:
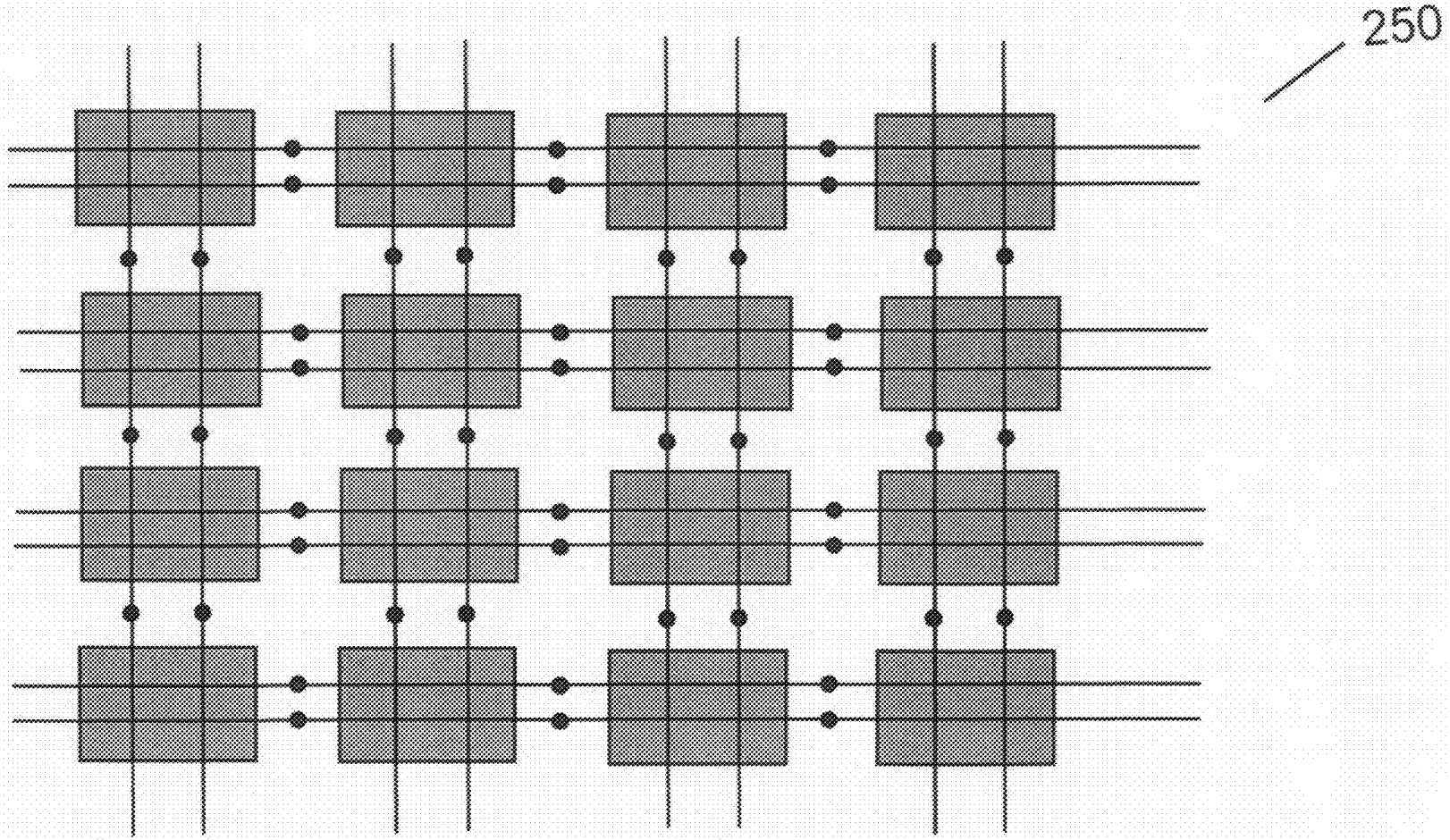
FIG. 5 shows one embodiment of the invention with sixteen slabs, connected together by carbon nanotube wires.

In one embodiment, after the concrete has solidified to form a solid slab, carbon nanotube wires extend out of the slab. If there is no neighboring slab, these carbon nanotube wires can be tied down to a structure, such as a pole. In another embodiment, carbon nanotube wires extended out from one slab are connected to carbon nanotube wires in neighboring slabs. FIG. 4 shows one embodiment 200 with nine slabs, connected together by carbon nanotube wires. For example, the carbon nanotube wire 204 of the slab 202 is tied to the carbon nanotube wire 206 of the slab 208 at the point 210. FIG. 5 shows another embodiment 250 with sixteen slabs, connected together by carbon nanotube wires. In this example, each slab has four carbon nanotube wires embedded inside. In one example, FIG. 5 shows the foundations for sixteen tract homes. In other examples, a slab can have more carbon nanotube wires embedded inside than the slabs previously described. In yet another example, slabs are not periodically arranged, and the slabs are not of the same size and shape, as in FIGS. 4 and 5.

Figure 6:
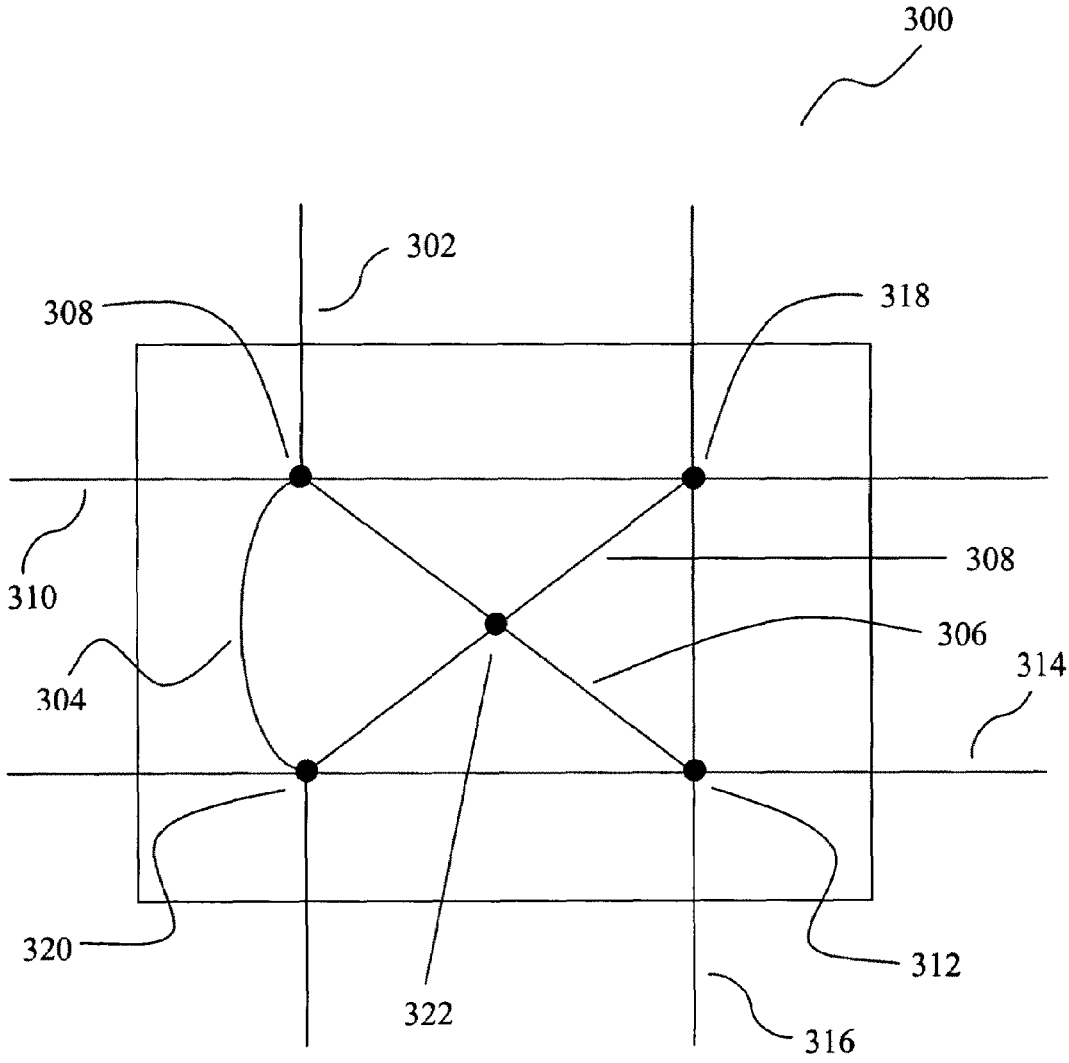
FIG. 6 shows another embodiment of the invention that has additional carbon nanotube wires inside a slab.

FIG. 6 shows another embodiment 300 that has additional carbon nanotube wires inside a slab. In the figure, one of the carbon nanotube wires 302 may have some slack 304. In this embodiment, additional carbon nanotube wires are tied between or among the carbon nanotube wires inside the slab. For example, a carbon nanotube wire 306 is tied between the intersection point 308 of the carbon nanotube wire 302 and the carbon nanotube wire 310, and the intersection point 312 of the carbon nanotube wire 314 and the carbon nanotube wire 316. Also, another carbon nanotube wire 308 is tied between the intersection point 318 of the carbon nanotube wire 310 and the carbon nanotube wire 316, and the intersection point 320 of the carbon nanotube wire 302 and the carbon nanotube wire 314. In addition, the two carbon nanotube wires 306 and 308 are tied together in the middle 322. The carbon nanotube wire can be tied by knots at the five intersecting points 308, 318, 312, 320 and 322. With more carbon nanotube wires tied together, such as the carbon nanotube wires 306 and 308, it is more difficult to stretch the slack 304 after the structure is formed.

In yet another embodiment, a mesh of carbon nanotube wires is formed inside the slab shown in FIG. 6, substantially along the plane of the slab. As an example, the mesh has three comers and three sides, with a plurality of carbon nanotube wires within the three comers, and the carbon nanotube wires are interconnected. Also, a carbon nanotube wire extends outward from the mesh at each corner. During formation of the slab, the mesh is stretched by the three outwardly extended carbon nanotube wires. In another example, a mesh can be similar to the structure shown in FIG. 6, the structure bounded by the four comers 308, 318, 312 and 320, with a cross inside. In another embodiment, a mesh has more carbon nanotube wires, such as more carbon nanotube wires inside, and they are interconnected together.

Figure 7:
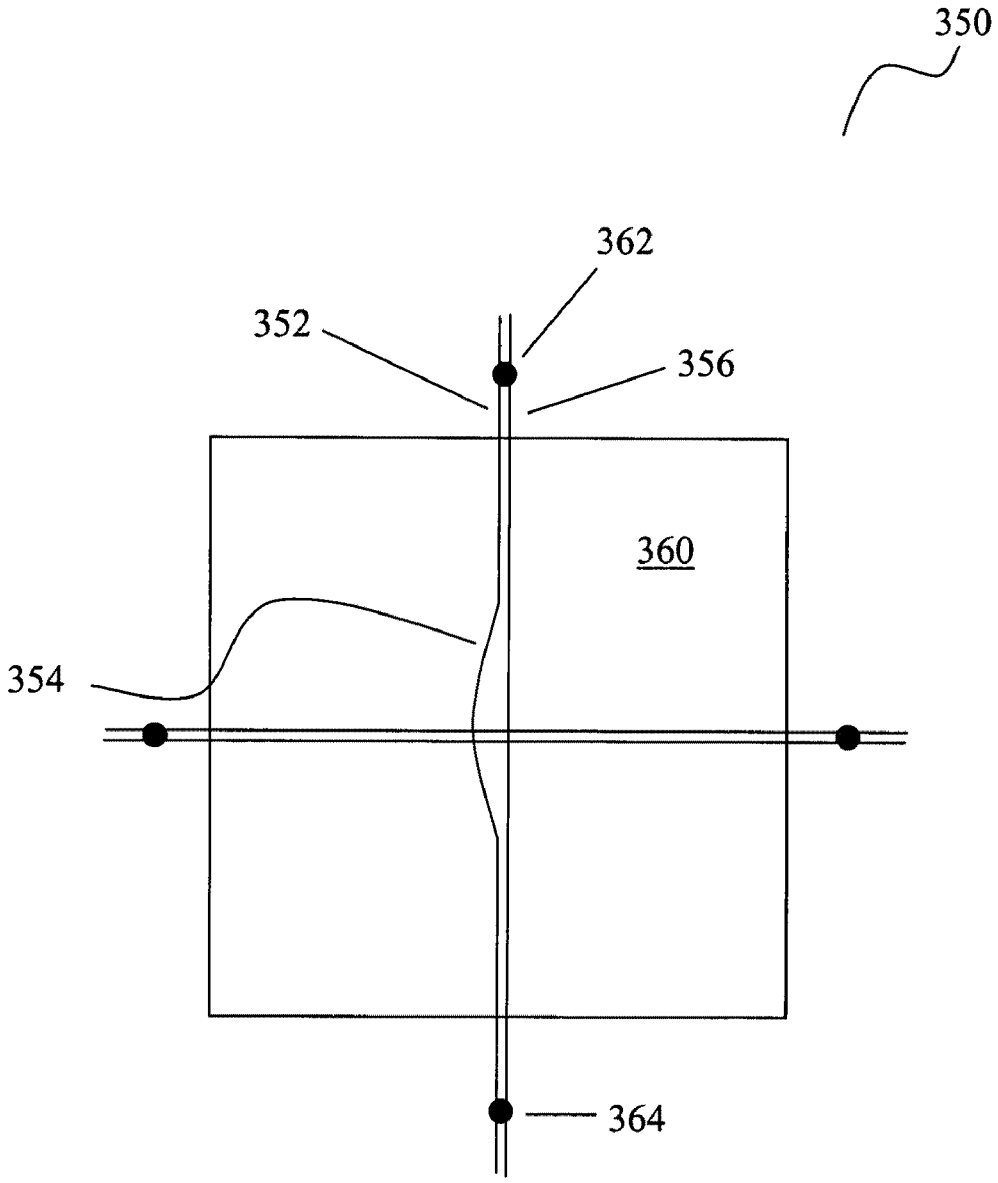
FIG. 7 shows another embodiment of the invention where a carbon nanotube wire has a neighboring carbon nanotube wire in close vicinity.

FIG. 7 shows an embodiment 350 where a carbon nanotube wire has a neighboring carbon nanotube wire in close vicinity. In one example, each carbon nanotube wire has a neighboring carbon nanotube wire in its immediate vicinity or in close vicinity, such as a few inches apart. The carbon nanotube wires can be separately formed, and during the formation process, they are stretched. In this example, after formation, one carbon nanotube wire 352 may have some slack 354, but its immediately neighboring carbon nanotube wire 356 is fairly tightly stretched. Then it is more difficult to straighten the carbon nanotube wire 352 after the structure is formed, if both the carbon nanotube wire 352 and its immediately neighboring carbon nanotube wire 356 have to extend approximately the same amount at the same time. In another example, neighboring carbon nanotube wires are tied together outside the slab. For example, the carbon nanotube wire 352 and its immediately neighboring carbon nanotube wire 356 are tied together outside the slab at points 362 and 364, which can be, for example, a foot away from the slab 360. In yet another example, neighboring carbon nanotube wires are substantially of the same length. During formation, their lengths are compared. If one is shorter than the other, the shorter one will be stretched until both are substantially the same length.

There can be different techniques to connect or to tie carbon nanotube wires. For example, one method is to tie the carbon nanotube wires together by knots as in ropes. Another example is to use chemicals, like glue, to tie one carbon nanotube wire to another carbon nanotube wire.

In one embodiment, with many of the slabs connected together by carbon nanotube wires, a web of slabs with carbon nanotube wires is created. Such a web of slabs strengthens each other, which in turn strengthens the structures on the slabs. Also, in the case of houses, this web of carbon nanotube wires is typically underground, below the houses. Thus, they would not be conspicuous and would not adversely affect the appearances of the houses.

In one embodiment, a slab for a house can have another piece of slab below it. This lower piece is connected to its corresponding upper piece, and the connection is not rigid. For example, they can be connected again via carbon nanotube wires. In between the upper and the lower slab, there can be a number of movable concrete spheres. In one embodiment, there can be carbon nanotube wires inside the spheres to strengthen them.

In another embodiment, a carbon nanotube wire is made by bundling many short carbon nanotubes together. In another example, a carbon nanotube wire is made by embedding short carbon nanotubes in other types of rope structures, such as nylon ropes and hemp ropes, as fibers inside these rope structures.

Different embodiments have been described regarding a web of carbon nanotube wires connecting different structures together. As an example, each carbon nanotube wire can have a diameter or thickness of about $1/32^{nd}$ to $1/16^{th}$ of an inch.

Typically, connecting more houses on slabs together tends to better strengthen their structures, and reduce the chance for such houses to be damaged by earthquakes and/or other forms of earth movement.

In another embodiment, different techniques described above can be used to help reduce the problem due to floating slab shifting. In cold climate where the ground freezes, a floating slab may shift. With a number of floating slabs connected together, the chance for, or the degree of, the slabs shifting is reduced.

A number of embodiments have been described above using a concrete slab of a certain thickness, such as about 4 to 6 inches, under a structure. In other embodiments, the slab under a structure, or the slab where a structure is built on or sits on, can be of different or the same thickness, and can be made of concrete or other materials.

A number of embodiments have been described with carbon nanotube wires inside a slab of solid materials. In different embodiments, the carbon nanotube wires described are outside and below a slab. For example, the carbon nanotube wires shown in FIG. 6 are below the slab. In another example, there can be a mesh of carbon nanotube wires, which is below a slab, such as among the points 308, 318, 312 and 320 in FIG. 6. One way to form such a structure is to put the carbon nanotube wires on the ground, stretch them, and then pour the materials to form the slab on top of them to form the slab. In yet another embodiment, these carbon nanotube wires can be used below other types of house structures or houses, in addition to, such as, houses on floating slab foundations. In other words, for example, a mesh of carbon nanotube wires provides support to a house or other structures when the ground underneath them is giving way, yielding or collapsing.

The various embodiments, implementations and features of the invention noted above can be combined in various ways or used separately. Those skilled in the art will understand from the description that the invention can be equally applied to or used in other various different settings with respect to various combinations, embodiments, implementations or features provided in the description herein.

In this specification, reference to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

The invention claimed is:

1. An apparatus to reduce damages to structures due to earth movement comprising:

a central slab;

a plurality of neighboring slabs adjacent to the central slab, each slab being spaced apart from each of the other slabs; and at least one carbon nanotube wire embedded in each slab, wherein the at least one carbon nanotube wire embedded in the central slab is connected to the at least one carbon nanotube wire embedded in a neighboring slab, wherein there is a structure on the central slab, and there is another structure on at least one other slab, and wherein the apparatus is configured to reduce damages to the structure due to earth movement.

2. An apparatus as recited in claim 1, wherein the apparatus is configured to reduce damages to houses, and the structure is a house.

3. An apparatus as recited in claim 1, wherein the carbon nanotube wire embedded in the central slab is oriented substantially along the plane of the central slab, and wherein the central slab further comprises at least one carbon nanotube wire that is oriented substantially perpendicular to the plane of the central slab.

4. An apparatus as recited in claim 3, wherein the at least one substantially-perpendicular nanotube wire is connected to the at least one along-the-plane nanotube wire of the central slab.

5. An apparatus as recited in claim 1, wherein the central slab has at least two sides, and wherein there are two neighboring slabs, one on each side of the central slab, and wherein the at least one carbon nanotube wire embedded in the central slab is connected to the at least one carbon nanotube wire embedded in each of the two neighboring slabs, one on each side of the central slab.

6. An apparatus as recited in claim 1, wherein the apparatus further comprises:

a plurality of secondary slabs adjacent to each of the neighboring slab, each of the secondary slabs not being the central slab or a neighboring slab, at least one carbon nanotube wire embedded in each secondary slab, and the at least one carbon nanotube wire in a neighboring slab is connected to a carbon nanotube wire in one of its corresponding secondary slabs, wherein each secondary slab is spaced apart from each of the other slabs.

7. A method to reduce damages to structures due to earth movement comprising:

embedding at least one carbon nanotube wire in a central slab;

embedding at least one carbon nanotube wire in each of a plurality of neighboring slabs, which are adjacent to the central slab, with each slab being spaced apart from each of the other slabs; and connecting the at least one carbon nanotube wire embedded in the central slab to the at least one carbon nanotube wire embedded in a neighboring slab, wherein there is a structure on the central slab, and there is another structure on at least one other slab, and wherein the method is configured to reduce damages to the structure due to earth movement.

8. A method as recited in claim 7, wherein the method is configured to reduce damages to houses, and the structure is a house.

9. A method as recited in claim 7, wherein the carbon nanotube wire embedded in the central slab is oriented substantially along the plane of the central slab, and wherein the method further comprises embedding at least one carbon nanotube wire in the central slab that is oriented substantially perpendicular to the plane of the central slab.

10. A method as recited in claim 9, wherein the at least one substantially-perpendicular nanotube wire is connected to the at least one along-the-plane nanotube wire of the central slab.

11. A method as recited in claim 7, wherein the central slab has at least two sides, and wherein there are two neighboring slabs, one on each side of the central slab, and wherein the at least one carbon nanotube wire embedded in the central slab is connected to the at least one carbon nanotube wire embedded in each of the two neighboring slabs, one on side of the central slab.

12. A method as recited in claim 7, wherein a plurality of secondary slabs are adjacent to each of the neighboring slab, each of the secondary slabs is not the central slab or a neighboring slab, and wherein the method further comprises:

embedding at least one carbon nanotube wire in each secondary slab; and connecting the at least one carbon nanotube wire in a neighboring slab to a carbon nanotube wire in one of its corresponding secondary slabs, wherein each secondary slab is spaced apart from each of the other slabs.

13. A method as recited in claim 7, wherein each slab changes from liquid to solid phase during its formation, wherein each of the carbon nanotube wire is embedded in its corresponding slab before the slab solidifies, and wherein at least one of the carbon nanotube wires is stretched to reduce slack during the period when the corresponding slab changes from liquid to solid phase.

14. A method as recited in claim 7, wherein the method further comprises embedding at least one additional carbon nanotube wires within a slab, substantially along the plane of that slab, the plurality of carbon nanotube wires in that slab being connected.

15. A method as recited in claim 7, wherein the method further comprises embedding another carbon nanotube wire in close vicinity to the at least one carbon nanotube wire in the central slab.

16. A method as recited in claim 7, wherein the method further comprises connecting the at least one carbon nanotube wires in the central slab to the at least one carbon nanotube wire in the neighboring slab together outside the slabs.

17. An apparatus to reduce damages to structures due to earth movement comprising:

a central slab;

a plurality of neighboring slabs adjacent to the central slab, each slab being spaced apart from each of the other slabs; and a plurality of carbon nanotube wires being below each slab and supporting each slab, wherein at least one carbon nanotube wire of the central slab is connected to at least one carbon nanotube wire of a neighboring slab, wherein there is a structure on the central slab, and there is another structure on at least one other slab, and wherein the apparatus is configured to reduce damages to the structure due to earth movement.

18. An apparatus as recited in claim 17, wherein the central slab has at least two sides, wherein there are two neighboring slabs, one on each side of the central slab, and wherein the carbon nanotube wires of the central slab are connected to the carbon nanotube wires of each of the two neighboring slabs, one on each side of the central slab.

19. An apparatus as recited in claim 17, wherein the apparatus is configured to reduce damages to houses, and the structure is a house.

20. An apparatus as recited in claim 17, wherein the carbon nanotube wires below a slab are connected, and wherein the carbon nanotube wires of the central slab are connected to the carbon nanotube wires of two neighboring slabs.

* * * * *